US009676202B2

(12) United States Patent
Leighton et al.

(10) Patent No.: US 9,676,202 B2
(45) Date of Patent: Jun. 13, 2017

(54) SYSTEM AND METHOD FOR DETECTING DEFECTS IN AN INKJET PRINTER

(75) Inventors: Roger G. Leighton, Hilton, NY (US); Piotr Sokolowski, Webster, NY (US); James E. Williams, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 958 days.

(21) Appl. No.: 13/467,390

(22) Filed: May 9, 2012

(65) Prior Publication Data

US 2013/0300794 A1 Nov. 14, 2013

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 2/175*** | (2006.01) |
| ***B41J 11/00*** | (2006.01) |

(Continued)

(52) U.S. Cl.

CPC ..... *B41J 2/17593* (2013.01); *B41J 11/0005* (2013.01); *B41J 11/0095* (2013.01); *B41J 11/42* (2013.01); *B41J 15/04* (2013.01)

(58) Field of Classification Search

CPC ... B41J 11/00; B41J 13/00; B41J 13/02; B41J 15/00; B41J 15/16; B41J 11/0015; B41J 11/42; B41J 29/38; B41J 29/387; B41J 29/393; B41J 11/0095; B41J 15/04; B41J 11/0005; B41J 2/17593; B65H 43/00; B65H 43/04; B65H 63/00; B65H 63/06; B65H 2553/82; B65H 2553/822; B65H 2301/142; B65H 2301/212; B65H 2511/13; B41M 5/52

USPC ..... 347/5, 8, 16, 19, 101, 104, 14; 271/258.01, 265.01, 275, 276

See application file for complete search history.

(56) References Cited

U.S. PATENT DOCUMENTS

| | | | | |
|---|---|---|---|---|
| 4,182,259 A * | 1/1980 | Garner et al. | ..... | 118/712 |
| 5,075,622 A * | 12/1991 | Konii et al. | ..... | 324/229 |
| 5,525,809 A * | 6/1996 | Bolea | ..... | 250/559.27 |

(Continued)

FOREIGN PATENT DOCUMENTS

| | | | | |
|---|---|---|---|---|
| JP | 64015953 U * | 1/1989 | ..... | G01N 21/89 |
| JP | 06180295 A * | 6/1994 | ..... | G01N 21/89 |

(Continued)

OTHER PUBLICATIONS

Awata, H06-180295 A (Machine Translation), JPO, all pages, downloaded from https://dossier1.j-platpat.inpit.go.jp/tri/all/odse/ODSE_GM101_Top.action on May 4, 2015.*

(Continued)

*Primary Examiner* — Jannelle M Lebron

(74) *Attorney, Agent, or Firm* — Maginot Moore & Beck LLP

(57) ABSTRACT

An inkjet printer for printing on a continuous web of recording media includes a receiver to receive a beam of collimated light transmitted across the surface of a continuous web of recording media supported by a roller. The intensity of the transmitted beam received by the receiver can be used to determine the presence of a defect in the continuous web or in the roller. A controller is configured to reduce the speed of or stop movement of the web through the printer and to retract one or more printheads from a printing location to prevent the defect from damaging the printhead(s).

12 Claims, 5 Drawing Sheets

(51) Int. Cl.
*B41J 11/42* (2006.01)
*B41J 15/04* (2006.01)

(56) References Cited

U.S. PATENT DOCUMENTS

| | | | | |
|---|---|---|---|---|
| 5,805,291 | A * | 9/1998 | Calvin et al. | 356/429 |
| 6,812,997 | B2 | 11/2004 | Kaltenbach et al. | |
| 7,434,902 | B2 * | 10/2008 | Baker et al. | 347/8 |
| 7,828,423 | B2 * | 11/2010 | Larson et al. | 347/88 |
| 8,162,425 | B2 * | 4/2012 | Kato et al. | 347/8 |
| 2004/0233244 | A1 * | 11/2004 | Elgee et al. | 347/19 |
| 2011/0279507 | A1 | 11/2011 | Castillo et al. | |

FOREIGN PATENT DOCUMENTS

| | | | | |
|---|---|---|---|---|
| JP | 2007010502 | A * | 1/2007 | |
| KR | 20060046140 | A * | 5/2009 | G01N 21/958 |

OTHER PUBLICATIONS

Moilanen, Pertti and Linqdvist, Ulf, "Web Defect Inspection in the Printing Press-Research Under the Finnish Technology Program," Tappi Journal, Sep. 1996.

* cited by examiner

SYSTEM AND METHOD FOR DETECTING DEFECTS IN AN INKJET PRINTER

TECHNICAL FIELD

This disclosure relates generally to detecting defects in a continuous web of recording media moving through a continuous web printer, and more particularly to detecting and taking corrective action to reduce or prevent damage to a printhead or to reduce or prevent image imperfections.

BACKGROUND

Inkjet printers operate a plurality of inkjets in each printhead to eject liquid ink onto an image receiving member. The ink may be stored in reservoirs that are located within cartridges installed in the printer. Such ink may be aqueous ink or an ink emulsion. Other inkjet printers receive ink in a solid form and then melt the solid ink to generate liquid ink for ejection onto the imaging member. In these solid ink printers, the solid ink may be in the form of pellets, ink sticks, granules, pastilles, or other shapes. The solid ink pellets or ink sticks are typically placed in an ink loader and delivered through a feed chute or channel to a melting device, which melts the solid ink. The melted ink is then collected in a reservoir and supplied to one or more printheads through a conduit or the like. Other inkjet printers use gel ink. Gel ink is provided in gelatinous form, which is heated to a predetermined temperature to alter the viscosity of the ink so the ink is suitable for ejection by a printhead. Once the melted solid ink or the gel ink is ejected onto the image receiving member, the ink returns to a solid, but malleable form, in the case of melted solid ink, and to gelatinous state, in the case of gel ink.

A typical inkjet printer uses one or more printheads with each printhead containing an array of individual nozzles through which drops of ink are ejected by inkjets across an open gap to an image receiving surface to form an ink image during printing. The image receiving surface may be the surface of a continuous web of recording media, a series of media sheets, or the image receiving surface may be a rotating surface, such as the surface of a rotating print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an aperture, usually called a nozzle, in a faceplate of the printhead. The actuators expel an ink drop in response to an electrical signal, sometimes called a firing signal. The magnitude, or voltage level, of the firing signals affects the amount of ink ejected in an ink drop. The firing signal is generated by a printhead controller with reference to image data. A print engine in an inkjet printer processes the image data to identify the inkjets in the printheads of the printer that must be operated to eject a pattern of ink drops at particular locations on the image receiving surface to form an ink image corresponding to the image data. The locations where the ink drops landed are sometimes called "ink drop locations," "ink drop positions," or "pixels." Thus, a printing operation can be viewed as the placement of ink drops on an image receiving surface with reference to electronic image data.

In order for the printed images to correspond closely to the image data, both in terms of fidelity to the image objects and the colors represented by the image data, the printheads are registered with reference to the image receiving surface and with the other printheads in the printer. Registration of printheads refers to a process in which the printheads are operated to eject ink in a known pattern and then the printed image of the ejected ink is analyzed to determine the relative positions of the printheads with reference to the imaging surface and with reference to the other printheads in the printer. Operating the printheads in a printer to eject ink in correspondence with image data presumes that the printheads are level with one another across a width of the image receiving member and that all of the inkjets in the printhead are operational.

The setting of a proper gap is important in a printer designed to accept a variety of imaging surfaces including those having different thickness or those that have a tendency to wrinkle. A thin layer of polytetrafluoroethylene (PTFE) is disposed on the printheads to provide accurate imaging. The PTFE layer controls the drooling pressure at the orifices of the printhead and should not be touched or burnished by wax or paper. If the PTFE is damaged, the drooling pressure can drop which in turn can alter the path of ejected ink drops as well as provide drooling or dripping of ink during printing resulting from weak and missing inkjets.

A continuous web of recording media is transported from a paper manufacturer to an end user as a roll of material. The outer edges of the web roll can be adversely affected during transportation due to shipping and handling. For instance either of the edges, which are often exposed, can be adversely affected. When the damaged edges move through the printer, the damaged edge can strike the face of the printhead due to the small gap between the surface of the recording media and the face of the printhead. These damaged edges can adversely impact the printheads. To reduce the risk of contact with the printheads, an operator typically cuts off about one inch of the outer edge of the web roll before mounting the web roll to the machine. While removing the outer one inch of material from the edges of the web roll can eliminate or substantially reduce damage to the printheads, this procedure is not desirable since both material and time are wasted.

In addition to edge defects being present in the web media, other defects can also occur, such as wrinkles or troughs. Wrinkles can occur when adjacent areas of the web media are forced closer together under stress. Wrinkles can result from a variety of sources, but typically occur during manufacture of the web media or preparing the web media for transport on a roll. Wrinkles oftentimes run lengthwise or along the process direction in the direction that the web media is transported through the printer. Troughs can also occur and are characterized as any long depression or channel. Troughs are often found to include a recessed area with respect to the rest of the surrounding web media, where the adjacent areas of the rest of the web media can be slightly elevated with respect to the trough.

Other web media defects not characterized as edge damage, wrinkles or troughs, can also be present in the recording media, such as foreign matter fixed in or held by the web media. Consequently, any change to the surface of the web media which deviates from a generally flat or smooth surface of the web can be considered as a defect. It is desirable therefore to prevent defects in the web media from reaching the printhead to reduce or prevent damage to the printhead.

While image quality suffers from defects in the recording media, poor image quality can also result from one or more printheads depositing ink at incorrect locations on the web media. For instance, if one of the rollers transporting the web media through the printer is out of round or the axis of rotation of the roller about a supporting rotational shaft is incorrect, improper registration of ink drops or pixel can occur. Consequently, it is also desirable to insure that defective transport rollers do not contribute to imaging errors.

The gap, or distance, between a printhead and the imaging surface is controlled to optimize the imaging process. If the gap is too small, burnishing of the printheads can occur when the image receiving surface contacts the face of the printheads. Burnishing not only can reduce the life of the printheads, but can produce poor image quality and increased downtime of the printer during maintenance. In one embodiment, if the gap between the printhead and the image receiving surface is less than about 0.6 millimeters, damage to the printhead, including burnishing, can occur.

SUMMARY

An inkjet printer for imaging a continuous web of recording media moving along a path in the printer and supported by a roller includes a detector located at an end of the roller to detect defects in the continuous web. The inkjet printer images a continuous web of recording media as the continuous web of recording media moves in a process direction and includes an inkjet printhead. The printhead is configured to eject ink onto the continuous web of recording media and a media transport is configured to transport the continuous web of recording media past the inkjet printhead. The media transport includes a roller having a first end and a second end. The roller is disposed in the printer at a location to support the recording media before the inkjet printhead ejects ink onto the continuous web of recording media. A transmitter is disposed at the first end of the roller to transmit a beam of laser light across the roller along a first path. A receiver is disposed at the second end of the roller to receive the transmitted beam of laser light and to generate a first signal in response to a portion of the continuous web of recording media positioned between the transmitter and the receiver and the roller diverting the laser light from the first path. A controller is operatively connected to the receiver to receive the first signal and to generate a second signal to modify operation of the inkjet printhead and the media transport.

A method for reducing damage to a printhead includes transmitting a beam of collimated laser light across a surface of a continuous web of recording media to detect defects in the recording media. The method includes transmitting a collimated beam of laser light across a surface of the continuous web of recording media supported by the roller; receiving the collimated beam of laser light; converting the received collimated beam of laser light to a first signal representative of the intensity of the received collimated beam of laser light; comparing the first signal to a threshold to provide a second signal having a first state indicative of a defect at the roller and a second state indicative of no defect at the roller; and modifying operation of the printer in response to the first state of the second signal.

BRIEF DESCRIPTION OF THE DRAWINGS

The foregoing aspects and other features of a printer having a defect detection system for detecting defects in a continuous web of recording media or in a transport roller are explained in the following description, taken in connection with the accompanying drawings.

DETAILED DESCRIPTION

Figure 1:
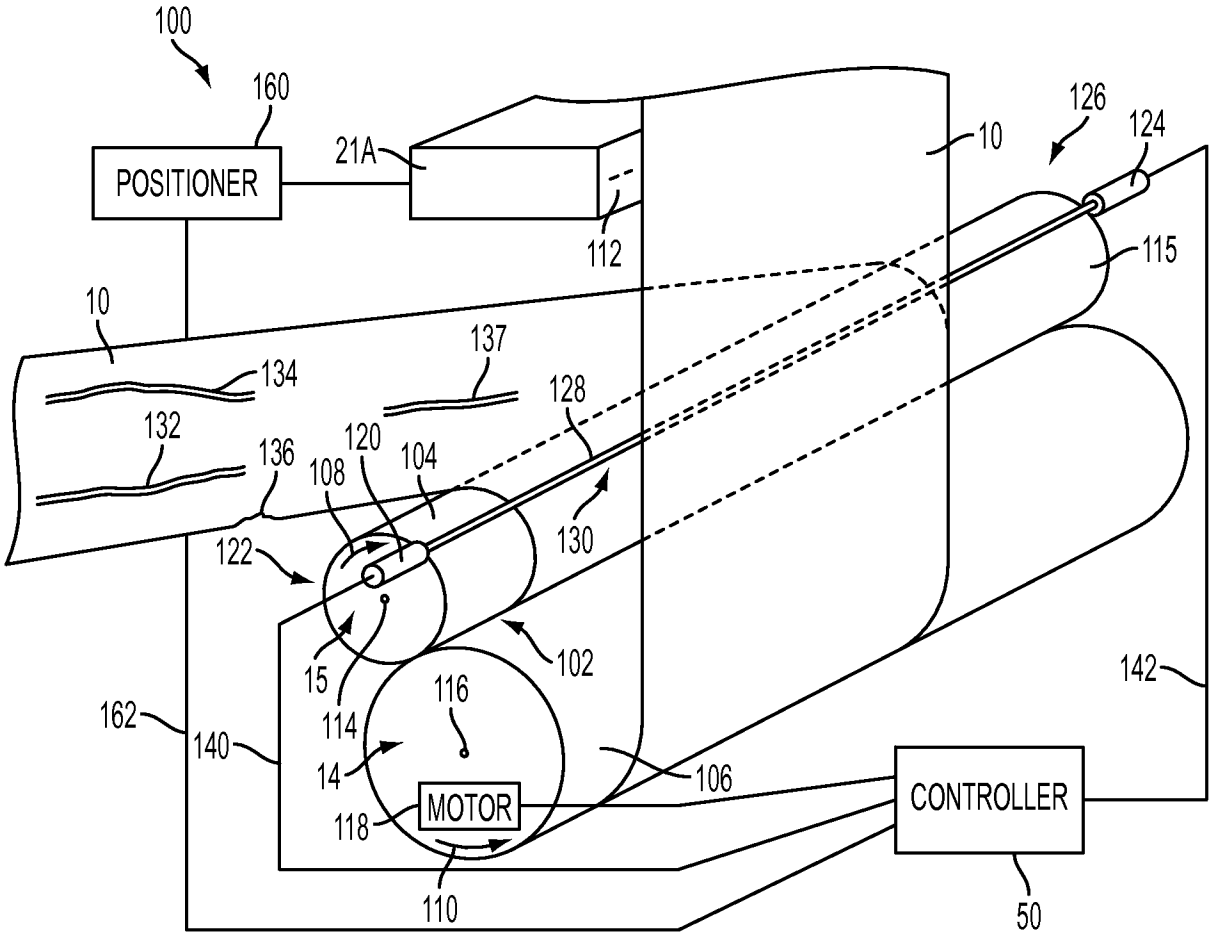
FIG. 1 is a perspective view of a defect detection system for use in a printer.

For a general understanding of the environment for the system and method disclosed herein as well as the details for the system and method, reference is made to the drawings. In the drawings, like reference numerals have been used throughout to designate like elements. As used herein the term "printer" refers to any device that is configured to form ink images on media and includes, but is not limited to, photocopiers, facsimile machines, multifunction devices, as well as direct and indirect inkjet printers. An image receiving surface refers to any surface that receives ink drops, such as an imaging drum, imaging belt, or various recording media including paper.

As used in this document, "ink" refers to a colorant that is liquid when applied to an image receiving surface. For example, ink can be aqueous ink, ink emulsions, solvent based inks and phase change inks. "Phase change ink" refers to inks that are in a solid or gelatinous state at room temperature and change to a liquid state when heated to an operating temperature for application or ejection onto the recording media. The phase change inks return to a solid or gelatinous state when cooled on the recording media after the printing process.

The term "printhead" as used herein refers to a component in the printer that is configured to eject ink drops onto an image receiving surface. A typical printhead includes a plurality of inkjets that are configured to eject ink drops of one or more ink colors onto the recording media. The inkjets are arranged in an array of one or more rows and columns. In some embodiments, the inkjets are arranged in staggered diagonal rows across a face of the printhead. Various printer embodiments include one or more printheads that form ink images on the recording media.

Figure 6:
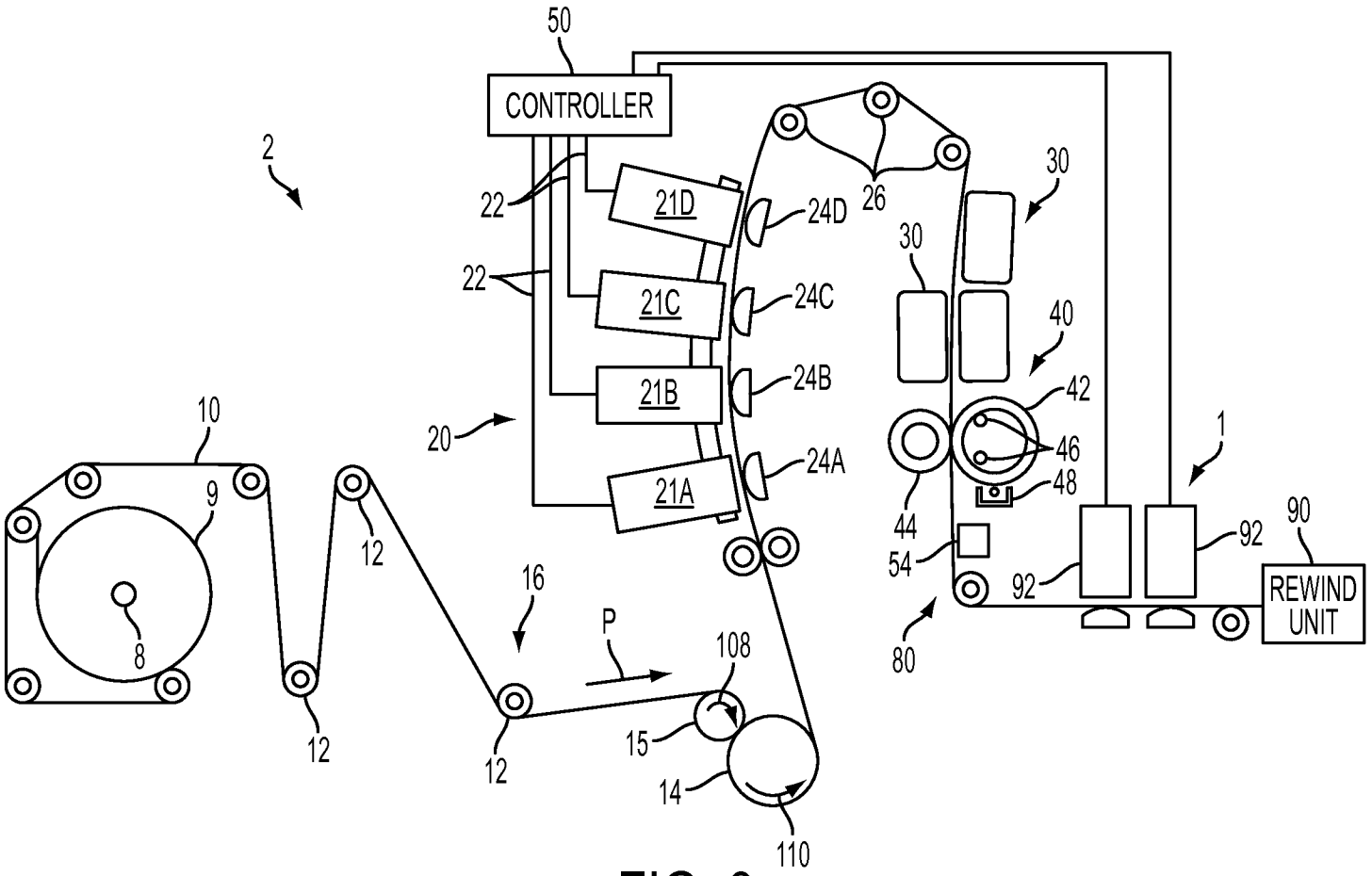
FIG. 6 PRIOR ART
FIG. 6 is a schematic view of a prior art inkjet imaging system that ejects ink onto a continuous web of recording media as the media moves past the printheads in the system.

FIG. 6 is a prior art inkjet printer that ejects ink onto a continuous web of media as the media moves past the printheads in the system. An embodiment of a printer, such as a high-speed phase change ink printer 2 in which the method and system for detecting a defect in a portion of a continuous web of recording media or in a support roller, is depicted. For the purposes of this disclosure, the inkjet printer 2 of FIG. 6 employs one or more inkjet printheads and an associated solid ink supply. The imaging apparatus includes a print engine to process the image data before generating the control signals for the inkjet ejectors. The colorant can be ink, or any suitable substance that includes one or more dyes or pigments that can be applied to the selected media. The colorant can be black, or any other desired color, and a given imaging apparatus can be capable of applying a plurality of distinct colorants to the media.

FIG. 6 is a simplified schematic view of a direct-to-sheet, continuous-media, phase-change inkjet printer 2, that can be modified to include a system and method for detecting defects in a continuous web of recording media or a support roller. A media supply and handling system is configured to supply a long (i.e., substantially continuous) web of recording media 10 of "substrate" (paper, plastic, or other printable material) from a media source, such as spool 9 of media 10 mounted on a web roller 8. For simplex printing, the printer is comprised of feed roller 8, media transport 16, printing station 20, printed web conditioner 80, coating station 1, and rewind unit 90. For duplex operations, a web inverter (not shown) is used to flip the web over to present a second side of the media to the printing station 20, printed web conditioner 80, and coating station 1 before being taken up by the rewind unit 90. In the simplex operation, the media 10 has a width that covers a portion of the width of the rollers over which the media travels through the printer. In duplex operation, the media source is approximately one-half of the roller widths as the web travels over one-half of the rollers in the printing station 20, printed web conditioner 80, and coating station 1 before being flipped by the web inverter and laterally displaced by a distance that enables the web to travel over the other half of the rollers opposite the printing station 20, printed web conditioner 80, and coating station 1 for the printing, conditioning, and coating, if necessary, of the reverse side of the web. The rewind unit 90 is configured to wind the web onto a roller for removal from the printer and subsequent processing.

The media can be unwound from the source 9 as needed and propelled by a variety of motors (not shown) rotating one or more rollers. The media transport 16 includes rollers 12, preheat drum 14, and an idler roller 15 associated with preheat drum 14. An additional preheater (not shown) can be included after the preheat drum 14 to maintain the temperature of the web before printing. The additional preheater can use contact, radiant, conductive, or convective heat to set or maintain the media at a target preheat temperature. The rollers 12 and roller 15 can control the tension of the unwinding media as the media moves along a path through the printer. In alternative embodiments, the media can be transported along the path in cut sheet form in which case the media supply and handling system can include any suitable device or structure that enables the transport of cut media sheets along a desired path through the imaging device. The preheat drum 14 brings the web to an initial predetermined temperature that is selected for desired image characteristics corresponding to the type of media being printed as well as the type, colors, and number of inks being used. The preheat drum 14 can be driven by a motor and can be considered a drive roller. The preheat drum 14 generally provides contact heat provided by a heating device disposed within the preheat drum 14. In one practical embodiment, the preheat temperature is in a range of about 30 degrees C. to about 70 degrees C.

The media is transported through a printing station 20 that includes a series of printhead modules, which are sometimes known as print box units, 21A, 21B, 21C, and 21D, each printhead module effectively extending across the width of the media and being able to place ink directly (i.e., without use of an intermediate or offset member) onto the moving media. A printhead module can include one or more printheads operatively connected to a frame and aligned thereon for depositing ink to form an image. The printhead module can include associated electronics, ink reservoirs, and ink conduits to supply ink to the one or more printheads. Any one, some, or all of the printhead modules 21A-21D can be angled with respect to horizontal. As is generally familiar, each of the printheads of the printhead array can eject a single color of ink, one for each of the colors typically used in color printing, namely, cyan, magenta, yellow, and black (CMYK).

The controller 50 of the printer receives velocity data from encoders mounted proximately to rollers positioned on either side of the portion of the path opposite the four printheads to compute the position of the web as it moves past the printheads. The controller 50 uses these data to generate timing signals for actuating the inkjet ejectors in the printheads to enable the four colors to be ejected with a reliable degree of accuracy for registration of the different color patterns to form four primary color images on the media. The inkjet ejectors actuated by the firing signals corresponds to image data processed by the controller 50. The image data can be transmitted to the printer, generated by a scanner (not shown) that is a component of the printer, or otherwise generated and delivered to the printer. In various possible embodiments, a printhead module for each primary color can include one or more printheads; multiple printheads in a module can be formed into a single row or multiple row array; printheads of a multiple row array can be staggered; a printhead can print more than one color; or the printheads or portions thereof can be mounted movably in a direction transverse to the process direction P, such as for spot-color applications and the like.

The printer 2 uses "phase-change ink" as that term has been previously defined above. Associated with each printhead module is a backing member 24A-24D, typically in the form of a bar or roll, which is arranged substantially opposite the printhead on the back side of the media. Each backing member is used to position the media in front of the printhead opposite the backing member. Each backing member can be configured to emit thermal energy to heat the media to a predetermined temperature which, in one practical embodiment, is in a range of about 40 degrees C. to about 60 degrees C. The various backer members can be controlled individually or collectively as part of the media transport. The preheat drum 14, the printheads 21, backing members 24 (if heated), as well as the surrounding air, combine to maintain the media along the portion of the path opposite the printing station 20 in a predetermined temperature range of about 40 degrees C. to 70 degrees C.

As the partially-imaged media moves to receive inks of various colors from the printheads of the printing station 20, the temperature of the media is maintained within a given range. Ink is ejected from the printheads at a temperature typically significantly higher than the image receiving media temperature. Consequently, the ink heats the media. Therefore, other temperature regulating devices can be employed to maintain the media temperature within a predetermined range. For example, the air temperature and air flow rate behind and in front of the media can also impact the media temperature. Accordingly, air blowers or fans can be utilized to facilitate control of the media temperature. Thus, the media temperature is kept substantially uniform for the jetting of all inks from the printheads of the printing station 20. Temperature sensors (not shown) can be positioned along this portion of the media path to enable regulation of the media temperature. Temperature data can also be used by systems for measuring or inferring (from the image data, for example) how much ink of a given primary color from a printhead is being applied to the media at a given time.

Following the printing zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35 degrees C. to about 80 degrees C. The mid-heater 30 has the effect of equalizing the ink and substrate temperatures to within about fifteen degrees C. of each other. Lower ink temperature gives less line spread while higher ink temperature causes show-through (visibility of the image from the other side of the print). The mid-heater 30 adjusts substrate and ink temperatures to zero degrees C. to twenty degrees C. above the temperature of the spreader.

Following the mid-heaters 30, a fixing assembly 40 is configured to apply heat and/or pressure to the media to fix the images to the media. The fixing assembly can include any suitable device or apparatus for fixing images to the media including heated or unheated pressure rollers, radiant heaters, heat lamps, and the like. In the embodiment of the FIG. 6, the fixing assembly includes a "spreader" 40, which applies a predetermined pressure, and in some implementations, heat, to the media. The function of the spreader 40 is to take what are essentially droplets, strings of droplets, or lines of ink on web 10 and smear them out by pressure and, in some systems, heat, so that spaces between adjacent drops are filled and image solids become uniform. In addition to spreading the ink, the spreader 40 can also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the continuous web of recording media 10 to a temperature in a range from about 35 degrees C. to about 80 degrees C. In alternative embodiments, the fixing assembly can be configured to spread the ink using non-contact heating (without pressure) of the media after the print zone. Such a non-contact fixing assembly can use any suitable type of heater to heat the media to a desired temperature, such as a radiant heater, UV heating lamps, and the like.

In one embodiment, the roller temperature in spreader 40 is maintained at a temperature to an optimum temperature that depends on the properties of the ink, such as fifty-five degrees C. Generally, a lower roller temperature gives less line spread while a higher temperature causes imperfections in the gloss. Roller temperatures that are too high can cause ink to offset to the roll. In one practical embodiment, the nip pressure is set in a range of about 500 to about 2000 psi lbs./side. Lower nip pressure gives less line spread while higher pressure can reduce pressure roller life.

The spreader 40 can also include a cleaning/oiling station 48 associated with image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature as it is printed to enable spreading of the ink.

The coating station 1 applies a clear ink to the printed media. This clear ink helps protect the printed media from smearing or other environmental degradation following removal from the printer. The overlay of clear ink acts as a sacrificial layer of ink that can be smeared and/or offset during handling without affecting the appearance of the image underneath. The coating station 1 can apply the clear ink with either a roller or a printhead 92 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating can be formed using a reduced set of typical solid ink components or a single solid ink component, such as polyethylene wax, or polywax. As used herein, polywax refers to a family of relatively low molecular weight, straight chain, polyethylene or polymethylene waxes. Similar to the colored phase change inks, clear phase change ink is substantially solid at room temperature and substantially liquid or melted when initially jetted onto the media. The clear phase change ink can be heated to about one hundred degrees C. to one hundred forty degrees C. to melt the solid ink for jetting onto the media.

Following passage through the spreader 40, the printed media can be wound onto a roller for removal from the system (simplex printing) or directed to the web inverter for inversion and displacement to another section of the rollers for a second pass by the printheads, mid-heaters, spreader, and coating station. The duplex printed material can then be wound onto a roller for removal from the system by rewind unit 90. Alternatively, the media can be directed to other processing stations that perform tasks such as cutting, binding, collating, and/or stapling the media or the like.

Operation and control of the various subsystems, components and functions of the printer 2 are performed with the aid of the controller 50. The controller 50 can be implemented with general or specialized programmable processors that execute programmed instructions. The instructions and data required to perform the programmed functions can be stored in memory associated with the processors or controllers. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The printer 2 can also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system can be a single light emitting diode (LED) that is operatively connected to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment can include three linear arrays, one for each of the colors red, green, and blue. Alternatively, all of the LEDS can be arranged in a single linear array in a repeating sequence of the three colors. The LEDs of the light source can be operatively connected to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array can be configured to translate across the image substrate. For example, the linear array can be mounted to a movable carriage that translates across image receiving member. Other devices for moving the light sensor can also be used.

FIG. 1 is a perspective view a defect detection system 100 including a portion of the media transport 16. The idler roller 15 is disposed adjacently to the drum 14 where a nip 102 is provided between a surface 104 of the idler roller 15 and a surface 106 of the drum 14. As the web 10 is unrolled from the web roller 8, the web 10 is supported by and in contact with the idler roller 15. As the web 10 continues to move from the idler roller 15 to the drum 14, the web 10 enters the nip 102. As illustrated, the web 10 moves about the idler roller in a clockwise direction 108, into the nip 102, and in a counterclockwise direction 110 around the drum 14. Once heated by the drum 14, the web 10 is transported to the inkjet printhead 21A where ink is deposited from nozzles 112 onto the web 10.

The idler roller 15 rotates freely in the illustrated embodiment and is not powered or driven by a motor or other driving mechanism. Other embodiments can include a roller 15 driven by a motor. The idler roller 15 is supported for rotation about a rotational axis 114 about which a body 115 rotates. The body 115 is substantially cylindrical and the surface can include a number of different materials including metal, rubber, and plastic. The surface 104 is substantially smooth and free of imperfections or other artifacts which can damage the web 10.

The idler roller 15 moves responsively to movement of the web 10 when the web is transported through the printer 2 by previously described transport mechanisms. In one embodiment, the drum 14 can be driven by a motor 118 which moves the drum 14 in the counterclockwise direction 110. The motor 118 is operatively connected to a shaft aligned along the rotational axis 116. The web 10 is heated by the drum 14 and travels toward the printhead 21A illustrated in FIG. 1, and past the remaining printheads previously described.

The defect detection system 100 includes a transmitter 120 located at a first end 122 of the idler roller 15 and a receiver 124 located a second end 126 of the idler roller 15. The transmitter 120 and the receiver 124 comprise an opposed arrangement, also known as a beam-through sensor, wherein the transmitter 120 transmits a luminescent beam of laser light 128 along a path 130 to the receiver 124 which receives all, a portion of, or none of the beam 128, depending on a condition of the continuous web 10 and the roller 15. The beam through arrangement does not rely on reflection of the beam 128 back to the transmitter 120 or to another receiver located at the first end 122 of the roller 15. Instead, the intensity of the beam 128 as received by the receiver 124 is provided by either the receiver 124 or the controller 50. In another embodiment, the transmitter 120 and the receiver 124 can be located at another roller not associated with the drum 14 or can be located to detect defects at the drum 14. The luminescent beam of laser light 128 does not provide any additional heat to the surface of the recording media so that preheating of the continuous web is not affected. In addition, because the web 10 is transported under tension through the printer, the web media at the roller 15 is held substantially flush against the roller to provide a substantially planar surface except for the appearance of defects.

The transmitter 120 and the receiver 124 are arranged with respect to the roller 15 such that the path 130 is aligned along a plane defined by a line extending from the axis of rotation 114 to a tangent of the surface 104 of the body 115. The transmitter 120 and receiver 124 are also located with respect to the roller 15 such that the path 130 is substantially parallel with respect to the rotational axis 114. Both the transmitter 120 and receiver 124 are respectively mounted to a support structure (not shown) to provide a fixed position of each with respect to the rotational axis 114 or the roller 15.

The transmitter 120 and receiver 124 are positioned at opposite ends of the idler roller 15 to detect defects in the continuous web 10 which is supported by the roller 15. The transmitter 120 generates a collimated beam of laser light towards the receiver 124 which senses a state of the transmitted beam of light 128. Depending on the state of the transmitted beam, the receiver 124 generates one or more signals to indicate the presence or absence of defects in the web 10.

In one embodiment, the transmitter 120 generates a beam of laser light having a diameter of approximately 0.7 millimeters. As the beam 128 moves in the path 130, the beam 128 can be obstructed either completely by or partially by a defect appearing in the web 10. Because the beam is relatively small, defects of difference sizes can be identified. As previously described for one embodiment, the gap between a printhead and the surface of the continuous web should not generally be less than 0.6 millimeters. Consequently, the transmitter 120 is located with respect to the surface 104 of the roller 15 to detect a defect which can contact one or more of the printheads. The receiver 124 is located at the second end 126 of the roller such that the transmitted beam of laser light 128 is essentially parallel to the surface 104 of the body 115 along the path 130. In other embodiments, the generated beam of laser light can include a cross-section that is not circular, such as a linear, a rectangular, or an elliptical cross-section.

If the web 10 includes a defect of sufficient magnitude, the beam of light is either completely or partially blocked by the defect. If blocked completely, the receiver 124 does not receive any of the transmitted light. If the light beam is partially blocked, the receiver 124 receives only a portion of the transmitted beam of light.

Defects of the web 10 can include a trough or depression 132, a wrinkle 134, or an edge defect 136. For each of these defects, the defect is exposed as a change in height of the web 10 from the surrounding portions of the web, which is substantially planar if there are no defects. In addition, the defects often appear in the process direction such as defect 137. Other defects, such as edge defect 136, can be found in the cross-process direction depending on the size, length, width and type of defect present in the web 10. While detecting the presence of a defect depends on the size of the defect, detecting the presence of a defect can also depend on the thickness of the recording media. Consequently, the locations of the transmitter 120 and the receiver 124, as positioned with respect to the surface of the roller 15, can be determined by taking into account the thickness of the web 10. In one embodiment, the location of the transmitter 120 and the receiver 124 with respect to the roller can be manually adjusted by an operator or user based on the thickness of the media web. In another embodiment, the location of the transmitter 120 and receiver 124 can be supported by an adjustable support mechanism operatively connected to the controller for automatically locating the height of the path 130 with respect to the surface 104. The controller 50 can be also be configured to control the height of the adjustable support mechanism in response to operator input.

The transmitter 120 can be operatively connected to the controller 50 through a connection 140. The controller 50 provides a signal to the transmitter 120 to indicate when the web 10 is transported through the printer. The receiver 124 can also be operatively connected to the controller 50 through a connection 142 to transmit a signal to the controller indicating the state of the transmitted beam of laser light 128. If there are no defects between the transmitter 120 and the receiver 124, the receiver 124 receives an unobstructed beam of light having a known intensity. If however, a defect appears in the web 10, the receiver 124 receives an obstructed beam of light having an intensity of less than the known intensity of the unobstructed beam.

Figure 2:
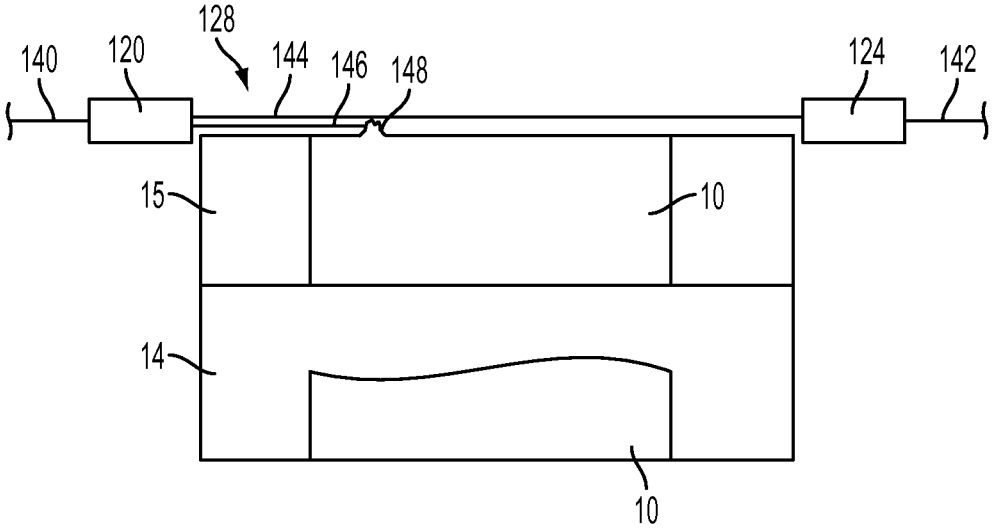
FIG. 2 is a schematic front view of a transmitter and a receiver to detect a defect of a first height with the transmitter and receiver disposed adjacently to an idler roller defining a nip with a preheat drum.
Figure 3:
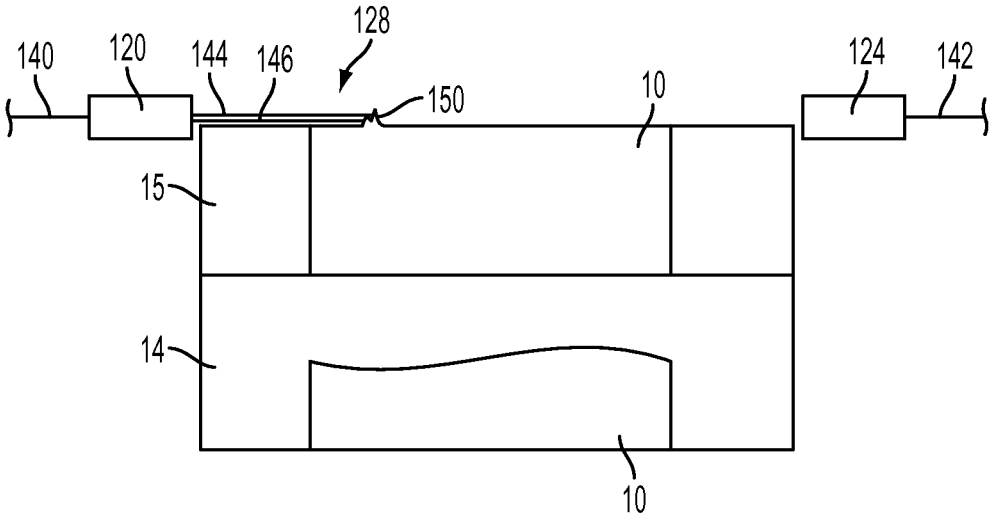
FIG. 3 is a schematic front view of a transmitter and a receiver to detect a defect of a second height with the transmitter and receiver disposed adjacently to an idler roller defining a nip with a preheat drum.

The obstructed condition is illustrated in FIG. 2, where the beam of light 128 is illustrated as being partially obstructed. The transmitter 120 generates a beam having a predetermined diameter, the edges of which are depicted by a first line 144 and a second line 146. A defect 148 obstructs only part of the beam of light 128 and consequently, only a portion of the beam 128 travels past the defect 148, here indicated as only the first line 144 passing the defect 148. In some situations, if the defect is sufficiently large, the receiver 124 does not receive any light beam as illustrated in FIG. 3. Under this condition, the beam 128 depicted by the first line 144 and the second line 148 is completely obstructed, such that no portion of the beam passes a defect 150. In other situations, the defect can have an acceptable height less than that which can cause damage, and does not obstruct the beam 128 so that the entire portion of the beam 128 reaches the receiver 124.

Figure 4:
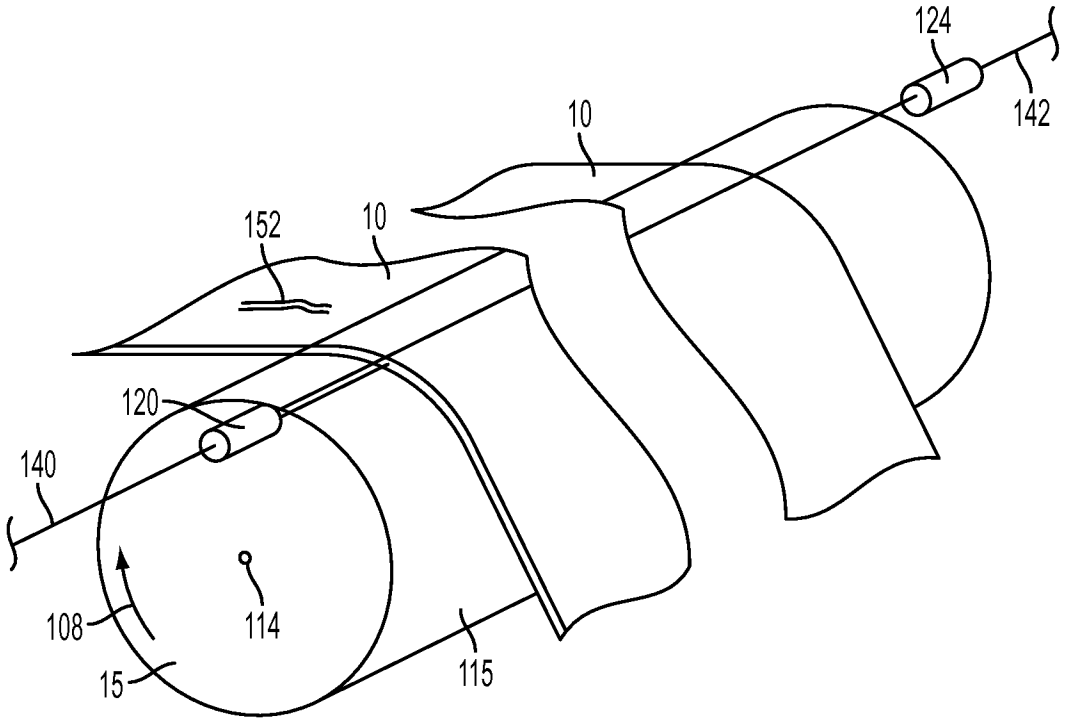
FIG. 4 is a partial perspective view of another embodiment of a transmitter and a receiver to detect an eccentricity of an idler roller defining a nip with a preheat drum (not shown).

In another embodiment illustrated in FIG. 4, the defect detection system 100 can detect a misaligned idler roller 15, an eccentricity of the cylindrical body 115, or a defect 152 in the web 10 as previously described. The preheat drum 14 is not shown. By using a collimated beam of light having a pre-determined cross-section, the detection system 100 can not only detect defects in the web 10, but can also detect defects related to the roller 15. For instance, if the rotational axis 114 is off-axis due to the shaft being misaligned or incorrectly supported by a support structure, if the body 115 is not substantially cylindrical, or if the surface 104 of the roller is not substantially smooth, the receiver 124 can detect the defect. While many of these defects to the roller 15 can be found before being assembled in the printer, some are not found and others can appear over time due to wear and tear. In general, the defects to the roller 15 can appear as an eccentricity which can be sensed when the collimated beam 128 is obstructed the roller.

Because there can be some eccentricity in the roller 15 which does not impact the printing of images, the controller 50 is configured to disregard a predetermined amount of eccentricity as "noise." In these situations, the eccentricity is not identified as a defect and no corrective action is taken.

The defect detection system includes one or more positioners which are operatively connected to each of the printheads in the printer 2, including a positioner 160 operatively connected to the printhead 21A as illustrated in FIG. 1. The positioner 160 is also operatively connected through a connection 162 to the controller 50 which is configured to generate and to transmit a signal for locating the printheads with respect to the web 10. If a defect occurs, the controller 50 transmits a position signal to the positioner 160 to move the printheads to a location sufficiently spaced from the web to prevent damage to the printhead. Once the defect has been corrected, the controller transmits a second position signal to the positioner 160 to move the printheads back to the printing position. In one embodiment, the printhead is retracted from the web media a distance of at least 2 millimeters.

Figure 5:
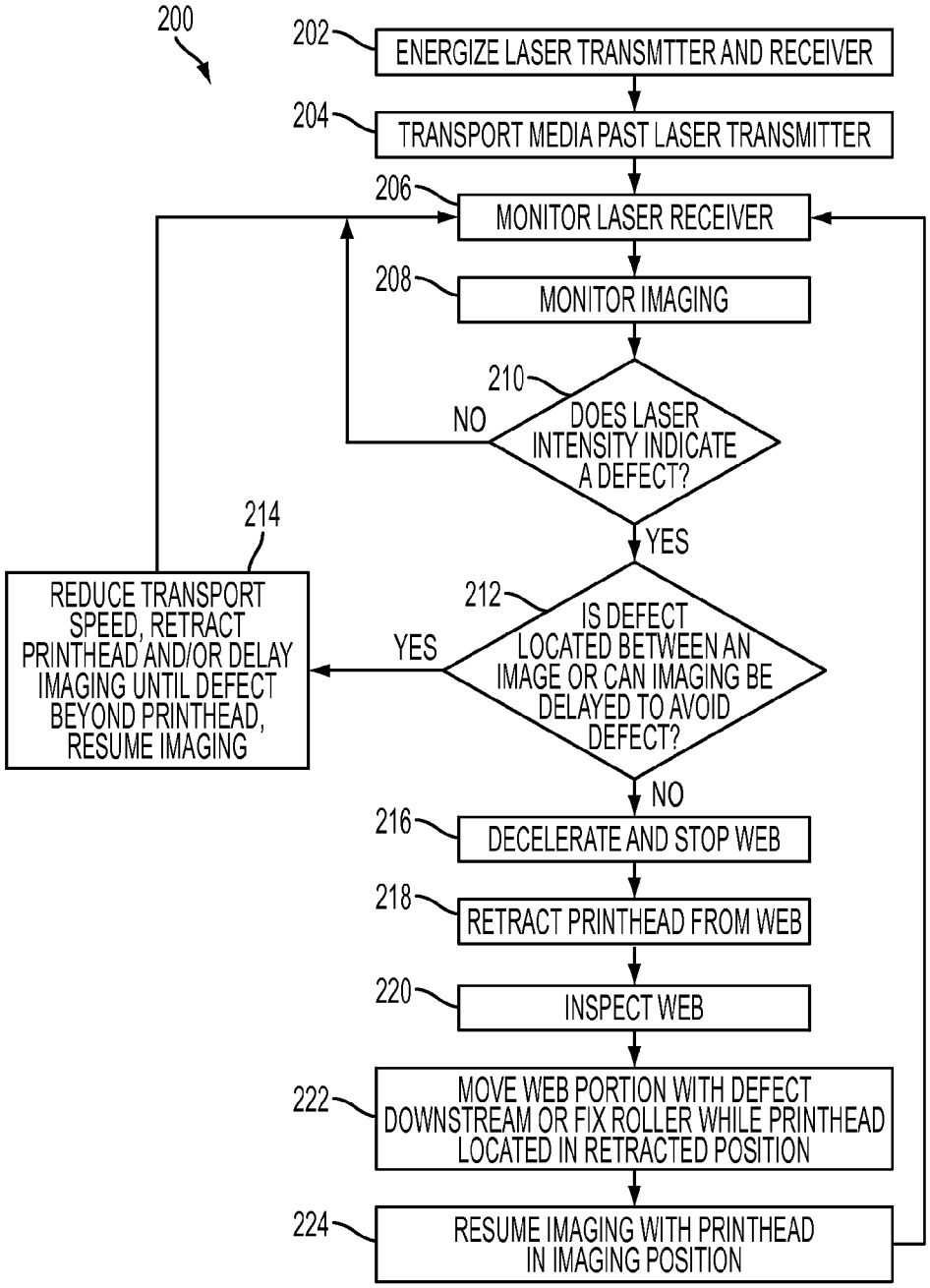
FIG. 5 is a flow diagram of a method for reducing damage to a printhead in a printer having a roller to support a continuous web of recording media moving past the printhead.

FIG. 5 illustrates one example of a method used to detect a defect in a roller, a defect in a continuous web of recording media, or an eccentricity resulting from the roller or mounting of the roller to the roller support. A flow diagram 200 of FIG. 5 describes a method applicable to the embodiments described herein, as well as to other embodiments incorporating the teachings described herein. As illustrated at block 202, the laser transmitter 120 is energized to direct a beam of collimated light across the surface of the roller 15 to the receiver 124. The controller 50, which is operatively connected to the transmitter 120, is configured to transmit a signal to the transmitter 120 for energization and to the receiver 124 for sensing the transmitted light. After energization, the media 10 is transported past the laser transmitter 120 to begin detection of defects (block 204). During transport of the media, the collimated beam of light is continually monitored by the receiver 124 (block 206). The receiver 124 provides an output signal to the controller 50 indicative of the state of the laser light as previously described.

In one embodiment, the receiver 124 receives the collimated light, generates a voltage level indicative of the intensity of the light received, and provides an output voltage to the controller 50 which is configured to identify defects. For instance, a voltage level threshold can be selected to indicate the presence of a defect. In one embodiment, the output signal of the receiver 124 can be selected to be normally low (below a predetermined value) to indicate that there are no defects. If the receiver output is high (above the predetermined value), a defect has been detected. In another embodiment, the occurrence of a defect can be defined if the voltage level is below the threshold and no defect is defined if the voltage level is above the threshold. In either embodiment, the signal transmitted to the controller 50 indicates the occurrence or non-occurrence of a defect. In one embodiment, the transmitter/receiver combination is a PepperI+Fuchs amplifier, SU-18-40a/110/115/123 and a fiber sensor, HPF-T070-H, both of which are available from PepperI+Fuchs Inc., Twinsburg, Ohio.

The controller 50 is also configured to monitor the occurrence and location of imaged (printed) areas and non-imaged (non-printed) areas of the web (block 208). Imaging of the web typically includes a number of individual printed pages each of which can be separated by a blank space (non-printed) located between the end of a first imaged area and the beginning of a second imaged area on the continuous web. An imaged area is typically referred to as a page, depending on the type or printing job being completed. By monitoring the location of the printed pages and the blank spaces, the location of defects in the process direction and cross-process direction can be identified with respect to printed pages and blank spaces. The operation at block 208 is not necessary, however, and can be eliminated.

The signal generated by the receiver 124 to indicate light intensity is monitored by the controller 50 where a comparison is made to the threshold. If the comparison indicates that the intensity of the collimated light has been sufficiently reduced to indicate a defect (block 210), the controller determines whether the defect is located between imaged areas or whether printing of the imaged areas can be delayed to avoid the web defect (block 212). If the intensity has not fallen below the threshold, the controller 50 continues to monitor the output of laser receiver 124 (block 206).

If, however, a defect is identified and printing of imaged areas or portions of the imaged areas can be delayed to avoid printing at the location of the defect (block 212), the controller 50 can generate and transmit a signal to provide one of, some of, or all of the following: reduce the transport speed of the media transport; retract the printhead if necessary; and delay printing until the defect is past the printhead. Once the defect has been managed, printing can be resumed (block 214)

If it is determined at block 212 that the defect cannot be managed appropriately, the controller 50 generates and transmits a signal to the media transport 16 to decelerate and to stop the transport to prevent further movement of the web within the printer (block 216). At substantially the same time, the controller generates and transmits the position signal to the positioner 160 to retract the printhead(s) from the web 10 (block 218). Once the web 10 is stopped, a user or operator inspects the web 10 to determine the type and extent of the defect (block 220). After the inspection is made, the portion of the web having the identified defect is moved, while the printhead is retracted, to a location where the defective portion can be removed. If the defect is in the roller 15, the roller 15 can be either repaired or replaced (block 222). After corrective action has been completed, the web is positioned within the printer to resume printing and the printhead is moved to the printing position. Printing is then resumed (block 224). Once printing resumes, the controller 50 resumes monitoring of the output of the receiver 124 at block 206.

It will be appreciated that several of the above-disclosed and other features, and functions, or alternatives thereof, can be desirably combined into many other different systems or applications. Various presently unforeseen or unanticipated alternatives, modifications, variations, or improvements therein can be subsequently made by those skilled in the art, which are also intended to be encompassed by the following claims.

What is claimed is:

1. An inkjet printer for imaging a continuous web of recording media as the continuous web of recording media moves in a process direction comprising:

an inkjet printhead configured to eject ink onto the continuous web of recording media;

a media transport configured to transport the continuous web of recording media past the inkjet printhead, the media transport including a roller having a first end and a second end, the roller disposed in the printer at a location to support the recording media before the inkjet printhead ejects ink onto the continuous web of recording media;

a transmitter disposed at the first end of the roller to transmit a beam of laser light across the roller along a first path;

a receiver disposed at the second end of the roller to receive the transmitted beam of laser light, the receiver being configured to generate a first voltage signal having a level that corresponds to an intensity of the transmitted beam of laser light received by the receiver, to compare the first voltage signal to a predetermined value that corresponds to only a predetermined portion of the transmitted beam of laser being received by the receiver, and to generate a second signal indicative of whether the first voltage signal exceeded the predetermined value; and a controller operatively connected to the receiver to receive the second signal and to generate a third signal to modify operation of the inkjet printhead and the media transport in response to the second signal indicating the predetermined value is less than the first signal.

2. The inkjet printer of claim 1 wherein the roller includes a substantially cylindrical body having a roller surface and a roller shaft to support the body for rotation about a rotational axis and the first signal is generated in response to one of an irregular roller surface, an irregular cylindrical body, and a roller shaft displaced from the rotational axis.

3. The inkjet printer of claim 1 wherein the roller includes a substantially cylindrical body having a predetermined amount of eccentricity and the controller is configured to identify the predetermined amount of eccentricity as noise when generating the third signal.

4. The inkjet printer of claim 1 further comprising a positioner, operatively connected to the printhead to move the printhead with respect to the media transport, wherein the second signal modifies the position of the positioner.

5. The inkjet printer of claim 4 wherein the positioner is operatively connected to the controller to receive the second signal.

6. The inkjet printer of claim 5 wherein the roller includes an axially disposed shaft defining a rotational axis and a substantially cylindrical body including a surface to directly support the recording media during transport thereof.

7. The inkjet printer of claim 6 wherein the first path is substantially parallel to the rotational axis.

8. The inkjet printer of claim 7 wherein the first path is approximately 0.60 millimeters from the surface of the roller.

9. The inkjet printer of claim 7 wherein the first path is approximately equal to the total amount of the thickness of the recording media plus 0.4millimeters.

10. The inkjet printer of claim 7 wherein the continuous web of recording media includes a substantially consistent thickness in a cross-process direction, and the first signal is generated in response to a change from the substantially consistent thickness at least partially obstructing the transmitted beam of laser light.

11. The inkjet printer of claim 10 wherein the change from the substantially consistent thickness includes a change disposed substantially in the process direction.

12. The inkjet printer of claim 11 wherein the change disposed substantially in the process direction includes one of a trough, a wrinkle, and damage to an edge of the continuous web of recording media.

* * * * *